US008297194B2

(12) United States Patent
Theurer et al.

(10) Patent No.: US 8,297,194 B2
(45) Date of Patent: Oct. 30, 2012

(54) TRACK MAINTENANCE VEHICLE HAVING A COVERED LOADING SPACE

(75) Inventors: Josef Theurer, Vienna (AT); Robert Fletzer, Voesendorf (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 189 days.

(21) Appl. No.: 12/734,278

(22) PCT Filed: Sep. 6, 2008

(86) PCT No.: PCT/EP2008/007300

§ 371 (c)(1),
(2), (4) Date: Apr. 22, 2010

(87) PCT Pub. No.: WO2009/052897

PCT Pub. Date: Apr. 30, 2009

(65) Prior Publication Data

US 2011/0271865 A1 Nov. 10, 2011

(30) Foreign Application Priority Data

Oct. 23, 2007 (AT) ..... A 1711/2007

(51) Int. Cl.
*E01B 29/05* (2006.01)

(52) U.S. Cl. ..... 104/2; 105/443; 105/444; 105/447

(58) Field of Classification Search ..... 104/2; 105/443–449
See application file for complete search history.

(56) References Cited

U.S. PATENT DOCUMENTS

| | | | | |
|---|---|---|---|---|
| 3,651,965 | A * | 3/1972 | Simonelli et al. | 414/540 |
| 4,270,630 | A * | 6/1981 | Karkau | 187/200 |
| 4,583,466 | A * | 4/1986 | Reddy et al. | 105/447 |
| 5,165,839 | A * | 11/1992 | Aoki | 414/541 |
| 5,171,123 | A * | 12/1992 | Nuyts et al. | 414/540 |
| 5,425,615 | A * | 6/1995 | Hall et al. | 414/545 |
| 5,573,080 | A * | 11/1996 | Theurer et al. | 182/2.3 |
| 5,904,098 | A * | 5/1999 | Theurer et al. | 104/2 |
| 6,305,897 | B1 * | 10/2001 | Budd et al. | 414/540 |
| 6,971,834 | B2 * | 12/2005 | Morris | 414/539 |
| 7,413,395 | B2 * | 8/2008 | Goodrich | 414/546 |
| 7,419,349 | B2 * | 9/2008 | Goodrich | 414/546 |
| 7,478,596 | B2 * | 1/2009 | Theurer | 104/2 |
| 7,913,628 | B2 * | 3/2011 | Chisena | 105/458 |
| 2006/0219123 | A1 * | 10/2006 | Theurer | 104/2 |
| 2008/0060545 | A1 * | 3/2008 | Barbara | 105/443 |
| 2008/0060875 | A1 * | 3/2008 | Barbara | 182/127 |
| 2008/0250966 | A1 * | 10/2008 | Hirtenlehner | 105/444 |
| 2011/0271865 | A1 * | 11/2011 | Theurer et al. | 104/2 |

FOREIGN PATENT DOCUMENTS

| | | |
|---|---|---|
| DE | 40 34 564 | 4/1992 |
| WO | WO 02/097218 | 12/2002 |

OTHER PUBLICATIONS

International Search Report.

* cited by examiner

*Primary Examiner* — Jason C Smith

(74) *Attorney, Agent, or Firm* — Collard & Roe, P.C.

(57) ABSTRACT

A track maintenance vehicle (1) has a covered loading space (12) resting on a machine frame (2) and a crane jib (16) pivotable by means of drives. A loading wall (20), connected to the machine frame (2) and provided for intermediate storage of goods (19) situated in the loading space (12), is adjustable into a horizontal working position (22) adjoining the loading space (12) laterally, with respect to the transverse direction of the vehicle.

6 Claims, 2 Drawing Sheets

Figure 1:
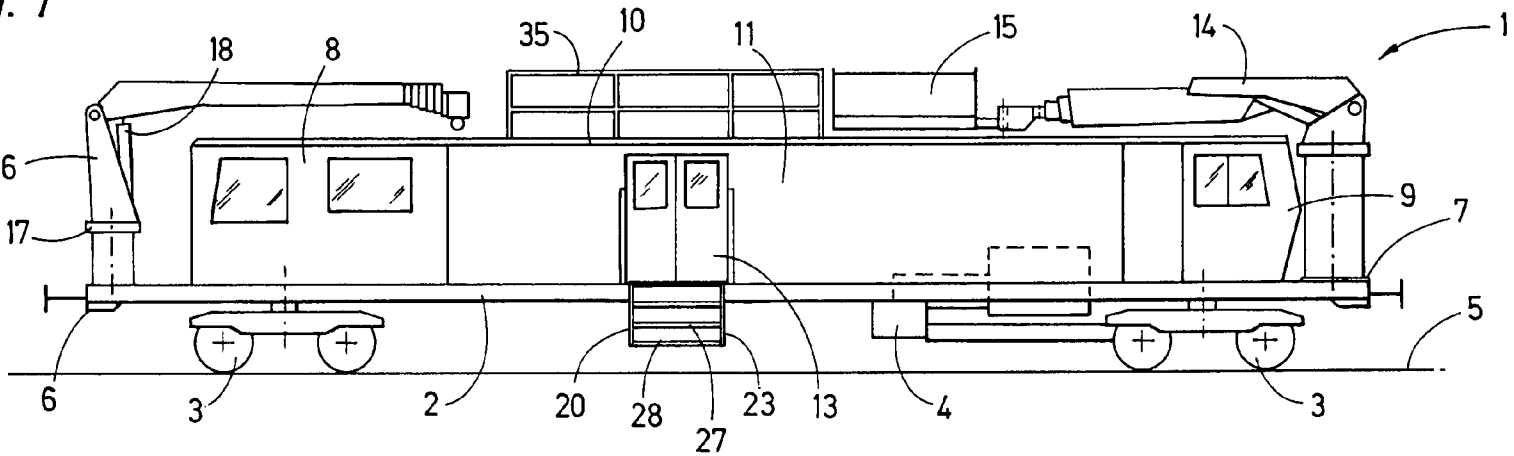

Fig. 3
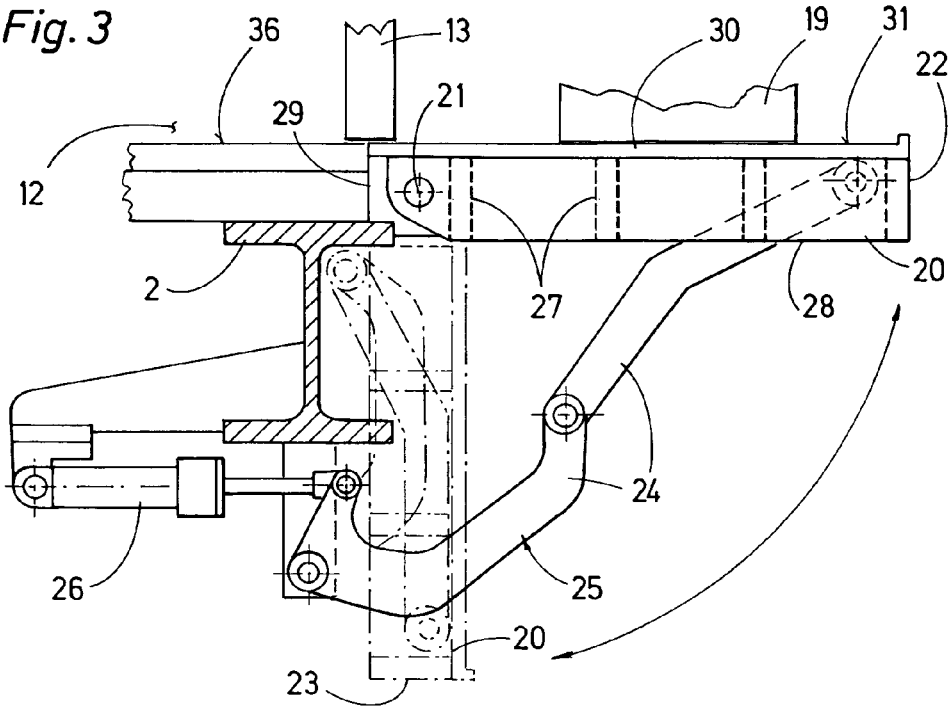
Fig. 4b
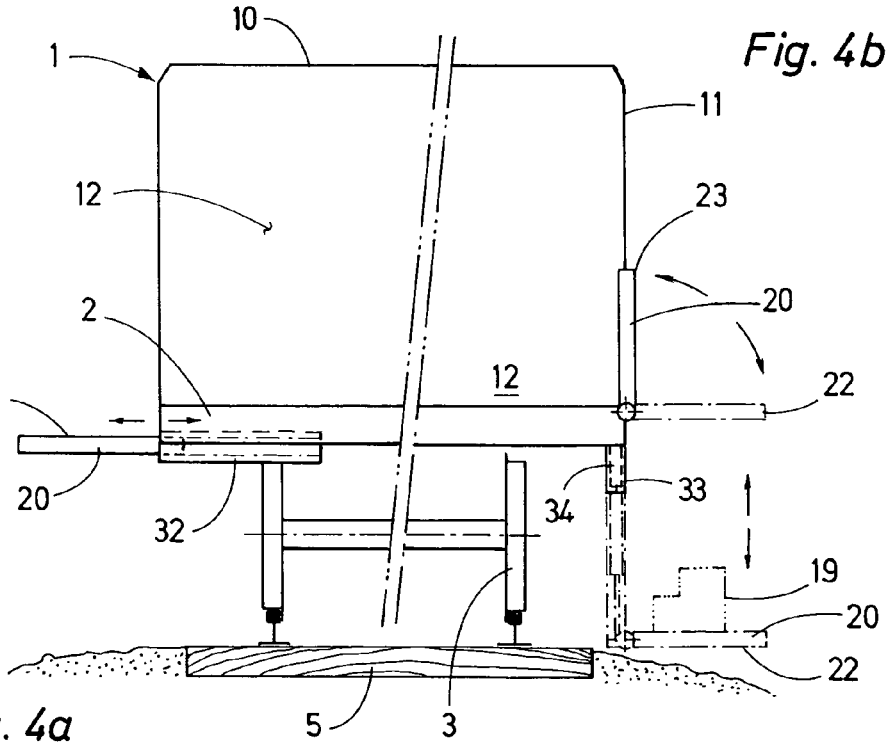
Fig. 4a

TRACK MAINTENANCE VEHICLE HAVING A COVERED LOADING SPACE

CROSS REFERENCE TO RELATED APPLICATIONS

This application is the National Stage of PCT/EP2008/007300 filed on Sep. 6, 2008, which claims priority under 35 U.S.C. §119 of Austrian Application No. A 1711/2007 filed on Oct. 23, 2007. The international application under PCT article 21(2) was not published in English.

The invention relates to a track maintenance vehicle having a covered loading space and a crane jib according to the introductory part of claim 1.

Track maintenance vehicles of this type are known (for example from U.S. Pat. No. 5,573,080) and have a machine frame mobile on a track. Customarily, driver's or operator's cabins are arranged on the machine frame at the ends, between which a covered region is provided which may serve for various purposes, such as crew quarters or as loading space. In addition to an extensible and vertically adjustable elevating work platform, the vehicle also has a crane jib pivotable by means of drives.

It is the object of the present invention to provide a track maintenance vehicle of the type mentioned at the beginning which enables unloading from the loading space in a simplified manner.

According to the invention, this object is achieved with a track maintenance vehicle of the specified kind by means of the features according to the characterising part of claim 1.

With this embodiment according to the invention, the working range of the crane jib is improved since there is no more necessity now for any restricted movement between the electrical catenary and the cover of the loading space. The goods to be loaded can be deposited for the time being or intermediately stored on the loading wall which is accessible by the crane jib without problems. Since the loading wall in its horizontal working position is situated laterally adjacent to the loading space—preferably at the same height as the loading space—a transverse displacement of the cargo out of the loading space or into the same can be managed particularly easily without special effort. An additional advantage of this solution lies also in the fact that a loading hatch in the region of the roof, which might be a problem to seal off, is not required.

Additional advantages of the invention become apparent from the dependent claims and the drawing description.

Figure 2:
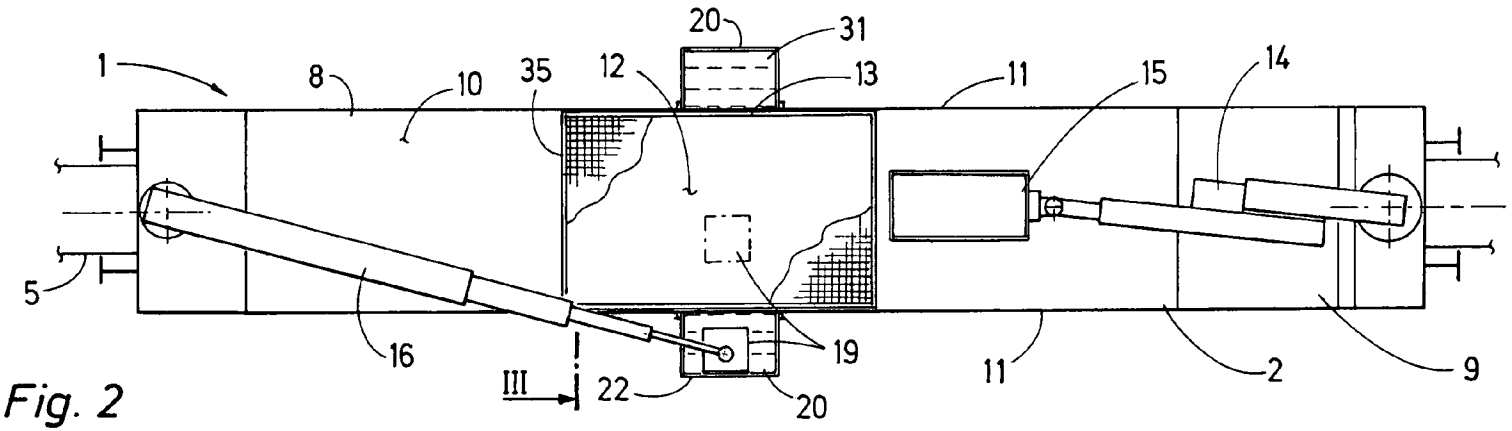

The invention will be described in more detail below with reference to embodiments represented in the drawing in which FIGS. 1 and 2 show a side view and top view, respectively, of a track maintenance vehicle equipped according to the invention, FIG. 3 shows a view of a loading wall according to arrow III in FIG. 2, and FIGS. 4*a* and 4*b* each show a highly schematic view, in the longitudinal direction of the vehicle, of further variants of the invention.

A track maintenance vehicle 1, visible in FIGS. 1 and 2, has a platform-like machine frame 2 which, by means of a motive drive 4, is mobile on a track 5 via on-track undercarriages 3 arranged at the ends. Located at either longitudinal end 6, 7 of the vehicle 1 is a respective driver's or operator's cabin 8, 9. The area of the machine frame 2 which lies between these two cabins 8, 9 comprises a roof 10 and is enclosed by side walls

11 for forming a loading space 12. The loading space 12 is accessible from both longitudinal sides of the vehicle 1 via loading doors 13.

Mounted on the machine frame 2 at one longitudinal end 7 is a crane 14 having a vertically and transversely adjustable work cage 15. At the other longitudinal end 6, a crane jib 16 is arranged which is designed to be rotatable, pivotable and extensible by means of drives 17, 18 and serves for lifting and transporting goods 19 during working operations of the track maintenance vehicle 1. A railing 35 provided on the roof 10 serves for safeguarding the operating personnel.

As can further be seen now in more detail also in FIG. 3, a loading wall 20 is provided in the region below the loading door 13, said loading wall 20 being connected to the machine frame 2 for pivoting about an axis 21 extending in the longitudinal direction of the vehicle. In the working position 22 (represented here in solid lines), the loading wall 20 serving for intermediate storage of goods 19 is situated—with respect to the transverse direction of the vehicle—laterally adjacent to the loading space 12, or rather adjoining the same, and is positioned at the same height horizontally as a loading surface 36.

In the inoperative position 23 (shown in dash-and-dotted lines), the loading wall 20 is arranged in a vertical position underneath the loading door 13 or loading surface 36. A lever linkage 25 consisting of two toggle levers 24 serves for pivoting of the loading wall 20 between the two said positions 22 and 23, said lever linkage 25 being actuatable by means of a hydraulic drive 26 supported on the machine frame 2. In this, the lever linkage 25 is configured in such a way that it supports the loading wall 20 in its horizontal working position 22 for safeguarding, rigidly locking it in position.

In the example shown here, the loading wall 20 is designed as an ascent stairway 28 having steps 27, which is mounted at its upper end 29 to the machine frame 2 by means of the axis 21 and, when in the inoperative position 23 (see FIG. 1), can be used by the operating personnel for access to the loading space 12. In the working position 22, a level load support surface 31 can be established with the aid of a plate 30.

In FIGS. 4*a* and 4*b*, alternative solutions of the invention can be seen, wherein, for the sake of simplicity, parts having the same function are denoted by the same reference numerals as in FIGS. 1 to 3.

FIG. 4*a* shows a loading wall 20 which is arranged underneath the machine frame 2 of the track maintenance vehicle 1 and displaceable with the aid of telescopically extensible guides 32 in the transverse direction of the vehicle into the working position 22 adjacent to the loading space 12.

In FIG. 4*b*, a further embodiment is shown in which the loading wall 20, when in its vertical inoperative position 23, forms part of the side wall 11 of the vehicle 1 and is folded outward or downward into the horizontal working position 22 when in operation. Additionally provided in said variant is also the possibility of vertically adjusting the loading wall 20 by means of vertical telescoping guides 33 with the aid of drives 34, namely from an upper working position 22—in which the loading wall 20 is placed laterally adjacent to the loading space 12—into a lower working position 22 (see dash-and-dot lines) in which the loading wall 20 is situated at ground level. This provides the possibility of particularly convenient access to the loading wall 20 for positioning and intermediate storage of goods 19.

The invention claimed is:

1. A track maintenance vehicle, having a covered loading space resting on a machine frame and a crane jib pivotable by means of drives, comprising:

a loading wall connected to the machine frame and provided for intermediate storage of goods situated in the loading space, the loading wall being adjustable into a horizontal working position adjoining the loading space laterally, with respect to the transverse direction of the vehicle, wherein the loading wall is positioned such that goods to be loaded can be deposited on the loading wall and wherein said loading wall is positioned to be accessible by the crane jib.

2. The vehicle according to claim 1, wherein the loading wall is designed as an ascent stairway having steps, which, for pivoting into the horizontal working position, is connected at an upper end to the machine frame via an axis extending in the longitudinal direction of the vehicle.

3. The vehicle according to claim 1, wherein the loading wall is connected to the machine frame via a lever linkage which is designed for securing and fixing the loading wall in its horizontal working position.

4. The vehicle according to claim 1, wherein the loading wall is designed for adjustment along vertical guides by means of drives from an upper working position into a lowering working position.

5. The vehicle according to claim 1, wherein the loading wall is arranged underneath the machine frame and, with the aid of telescopically extensible guides, is displaceable in the transverse direction of the vehicle into the working position.

6. The vehicle according to claim 1, wherein the loading wall is movable from a substantially vertical position to a substantially horizontal position.

* * * * *